US008842010B2

(12) United States Patent
Cehelnik

(10) Patent No.: US 8,842,010 B2
(45) **Date of Patent: *Sep. 23, 2014**

(54) METHOD FOR ALERTING PHYSICAL APPROACH

(75) Inventor: Thomas G Cehelnik, Vail, AZ (US)

(73) Assignee: Thomas G. Cehelnik, Tucson, AZ (US)

( * ) Notice: Subject to any disclaimer, the term of this patent is extended or adjusted under 35 U.S.C. 154(b) by 453 days.

This patent is subject to a terminal disclaimer.

(21) Appl. No.: 13/135,649

(22) Filed: Jul. 11, 2011

(65) Prior Publication Data

US 2013/0043995 A1 Feb. 21, 2013

Related U.S. Application Data

(63) Continuation of application No. 11/446,768, filed on Jun. 5, 2006, now Pat. No. 8,009,045.

(60) Provisional application No. 60/689,975, filed on Jun. 6, 2005.

(51) Int. Cl.
*G08B 13/26* (2006.01)

(52) U.S. Cl.
USPC ..... 340/561; 324/457; 361/179

(58) Field of Classification Search
USPC ..... 340/561, 686.6, 551–563; 324/457, 324/207.22, 687; 361/179
See application file for complete search history.

(56) References Cited

U.S. PATENT DOCUMENTS

| | | | |
|---|---|---|---|
| 4,016,490 A | 4/1977 | Weckenmann et al. | |
| 4,169,260 A | 9/1979 | Bayer | |
| 5,028,875 A | 7/1991 | Peters | |
| 5,130,672 A | 7/1992 | Watkiss et al. | |
| 5,408,411 A | 4/1995 | Makamura et al. | |
| 5,436,613 A | 7/1995 | Ghosh et al. | |
| 5,570,010 A | 10/1996 | Jin et al. | |
| 5,730,165 A | 3/1998 | Philipp | |
| 5,844,415 A | 12/1998 | Gershenfeld et al. | |
| 5,880,627 A | 3/1999 | Thiel | |
| 6,025,726 A | 2/2000 | Gershenfeld et al. | |
| 6,051,981 A | 4/2000 | Gershenfeld et al. | |
| 6,066,954 A | 5/2000 | Gershenfeld et al. | |
| 6,150,945 A | 11/2000 | Wilson | |
| 6,333,691 B1 | 12/2001 | Janus | |
| 6,628,265 B2 | 9/2003 | Hwang | |
| 6,686,800 B2 | 2/2004 | Krupka | |
| 6,859,141 B1 | 2/2005 | Van Schyndel et al. | |
| 6,968,171 B2 | 11/2005 | Vanderhelm et al. | |
| 8,009,045 B2 * | 8/2011 | Cehelnik | 340/561 |
| 2002/0093491 A1 | 7/2002 | Gillespie et al. | |

OTHER PUBLICATIONS

Morse et al.; Methods of Theoretical Physics, Part II: Chapters 9 to 13; McGraw-Hill Book Company, Inc.; 1953.

Seo et al; Electrical Impedance Tomography for Imaging and Lesion Estimation; Chapter 7; pp. 193-198, 2005.

Smith et al.; Field Mice: Extracting Hand Geometry From Electric Field Measurements; IBM Systems Journal; vol. 35. No. 384; 1996.

(Continued)

*Primary Examiner* — John A Tweel, Jr.

(74) *Attorney, Agent, or Firm* — Thomas G. Cehelnik

(57) ABSTRACT

A method and apparatus is described to detect the physical approach. The method is useful for passively detecting the presence of people, pets, or robots in proximity to a sensor. It is portable, and functions while being carried or placed inside objects.

20 Claims, 14 Drawing Sheets

(56) References Cited

OTHER PUBLICATIONS

William Beaty Publications on Internet in Regard to Electrostatic or Electric Field Sensors; http://www.amasci.com/electron/e-field2.txt; Note: DC Detection Only; 1994.

New Week Nov. 17, 2003; "Play Station 2 Gets an Eyeful" Demonstrates/Discusses Capability of MCS but Uses Camera/Video Instead of Electric Field Sensing.

William Beaty Internet Publication; 1987; "Ridiculously Sensitive Charge Detector"; DC Only; www.amasci.com/emotor/chargedet.html.

* cited by examiner

A)

B)

A)

B) 1 Sec /Div

METHOD FOR ALERTING PHYSICAL APPROACH

CROSS REFERENCE TO RELATED APPLICATIONS

This application is a Continuation application of Ser. No. 11/446,768, a Continuation-in-Part filed Jun. 5, 2006, now U.S. Pat. No. 8,009,045, and is to receive benefit. This application is to receive benefit of patent application Ser. No. 10/772,908 filed on 2004 Feb. 5, a nonprovisional regular application Ser. No. 10/978,142, now U.S. Pat. No. 7,078,911; and continuation-in-part application filed on 2004 Oct. 29 of Ser. No. 10/772,908 with Ser. No. 10/978,142 which is now U.S. Pat. No. 7,242,298. The regular nonprovisional application Ser. No. 10/772,908 claims benefit of provisional applications 60/445,548 filed 2003 Feb. 6, and 60/515,844 filed 2003 Oct. 30. The Continuation-in-Part application Ser. No. 11/446,768 claims benefit of provisional application 60/689,975 filed on Jun. 5, 2005.

STATEMENT OF FEDERALLY SPONSORED RESEARCH OR DEVELOPMENT

Not applicable

REFERENCE SEQUENCE LISTING OR COMPUTER PROGRAM

Not applicable

FIELD OF INVENTION

This invention relates to fields of computer peripherals and motion recognition systems for the control of electronic apparatus. Some specific uses are to aid in the input of commands to computerized devices through physical motion. These provide the ability for monitoring and improving the quality and enjoyment of physical exercise by streaming body motion and step movement, into audio streams for playback and practice. This may be done by marking or augmenting music songs or playing song sequences or music clips with detected movement through playback controls to music players and computers. To detect the approach of people and objects as in alarms. It is related to proximity and motion sensing of a person and objects. Includes alarms for vehicles, and see-thru sensing of walls and doors. Also relates to product tampering prevention as well by monitoring a device when it is approached or touched. Also included is ability to identify a product or object embedded with a coded signal or modulated signal for identification of a person, animal or object.

SUMMARY OF THE INVENTION

This invention relates to an apparatus and method for alerting of the physical approach of an individual or object to an area equipped with the invented alarm device. The alarm device technology is portable and easily configured as a personal alarm device to be carried in a pocket or purse. It can be place inside an automobile, or in a room to monitor approach to the secured area. Remote notification of access is available through various means of communicating the alarm signal. The alarm device can interface with remote or local devices through a communication link. The communication link may be wireless or a direct or networked electronic connection. The remote devices for dispatch the response to the triggering of the alarm such as sound audible alarms, lights, or provide for RF transmission to devices capable of providing sending e-mail, or making a cell phone. The communication link can power up and control additional security monitoring devices such as cameras, or activate physical controlled responses to the facilities. A system interface controllable from a computer allows for the queuing of monitoring and notification events.

The alarm device technology is useful for attaching to or integrating within building products such as doors, or wall panels, and windows. It also is useful when carried by a personal to detect the approach of another person, the alarm is clipped or placed in a pocket of the person, or within an object such as a mobile phone or PDA. For monitoring an area, the sensor is located in proximity or placing inside an object in proximity to the area. It may be placed inside a computer, or attractive to or placed inside a door, or simply left inside automobile to achieve monitoring within the vicinity. Many uses of the invented alarm device are foreseeable, particularly when using a remote communication connection technology. Remote devices are easily added to configure the system for personal use. Personal security monitoring services is also a possibility for certified systems.

BACKGROUND OF THE INVENTION

This invention applies the Motional Command Sensor technology described in the inventor's Motional Command System U.S. patent application Ser. No. 10/772,908, and supporting provisional applications. The citation discloses an E-field sensor that uses passive technology to detect motion of a body. The sensor also can detect control surface like the fingers and hand motion near the sensor and queue a response like instigating the pressing of a key on a keyboard without touching. An array of sensors is used to recognize motion or gestures and queue a computer response. The position of the control surface relative to the array is tracked and mapped to move the cursor.

This application relaxes the requirement that the electrical potential of the user's body is lower relative to earth ground than the potential at the sensor location. This improvement allows for even more general and extending applications of technology disclosed in MCS, and CP applications. In fact, it allows for a different method of using E-fields to detect proximity of a body, and this is referred to as a method to detect physical approach.

One aspect of the invention is to provide a method of sensing the approach of a person, object, or body, from behind walls, doors, windows or other barriers.

Another aspect of this invention is a method to alert individuals of the approach of a person, object, or body.

Another aspect of this invention is to passively sense the approach of an individual or object by using a sensor attached or concealed on an individual or their items.

Another aspect of this invention is to passively sense the approach of an individual or object by using a sensor concealed or located behind or within walls, doors, windows or other barriers.

Another aspect of the invention is to provide the said alarm device with a communication link capable of sending alarm information to remote devices.

Another aspect of the invention is additional modal sensor technology is queued such as a microphone, camera, or other modal response, in accord to resources available on the system as prescribed by the user of the device.

Yet, another aspect of the invention is to allow the operation of a wireless lanyard or leash for children or pets. A sensor on the pet modulates a signal in accordance that is detected by the master's sensor system. When the animal strays beyond a reasonable distance from the master, communication channel opens between the animal and the master. Such channels are either in the form of live radio communication or recorded playback commands on the dogs collar.

Another aspect of the invention is to provide a sensing method or alarm that is triggered to help prevent the collisions between objects such as people, robots, or objects such as vehicles.

DESCRIPTION OF THE PREFERRED EMBODIMENT

Figure 1:
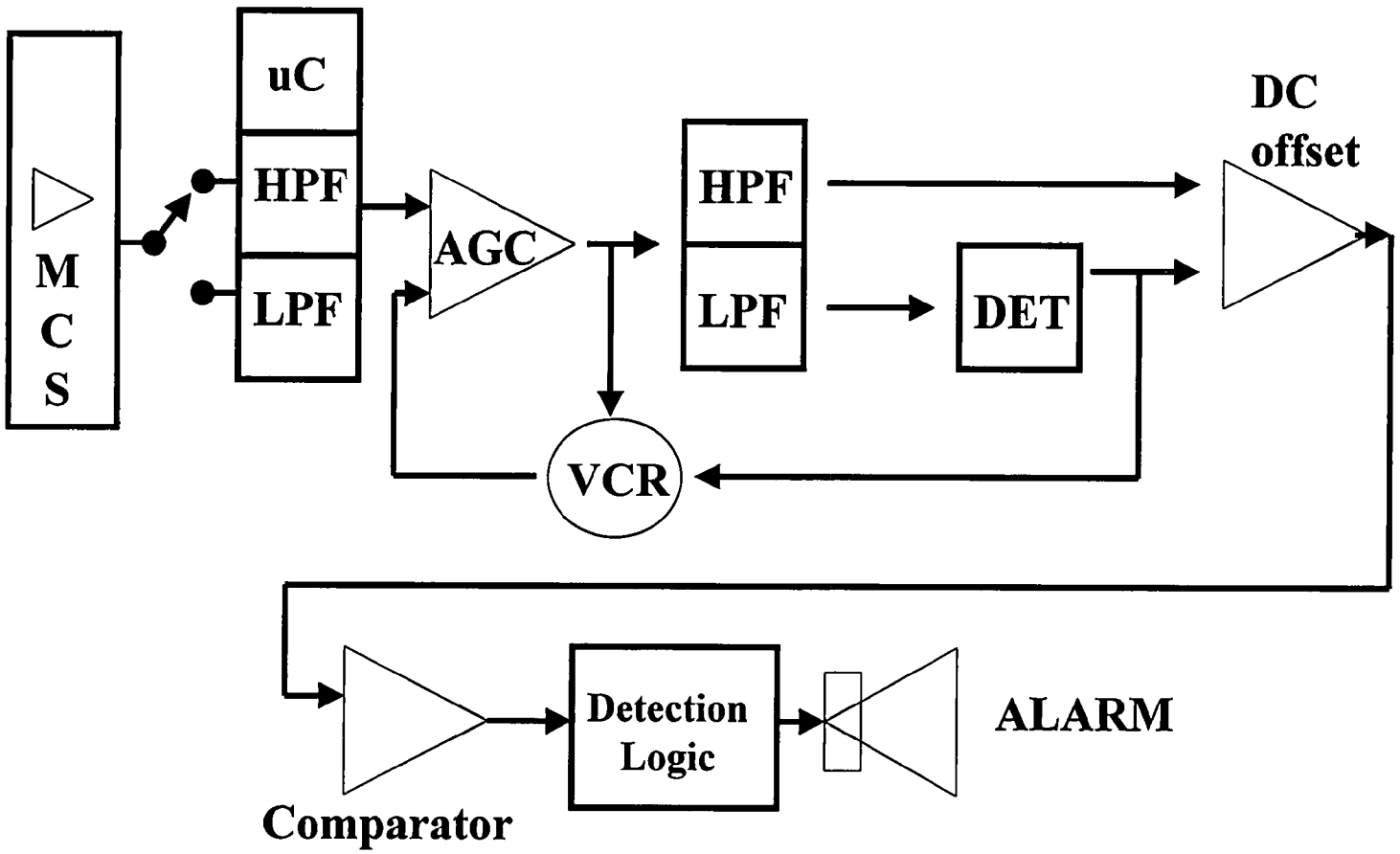
FIG. 1 shows a functional schematic of the physical approach sensor.

To those skilled in the art of alarm technology will recognize variations of said sensor types, placement, or signal combinations and triggering; but nevertheless this invention includes such variations.

Many times people experience the awkward feeling and dangerous situation of experiencing a collision when entering through a door. Also, when people are walking alone and experience physical contact or approach, the person would like to have an automatic alarm. The alarm should notify authorities and also record information such as the audio of the event. The triggering level of the device should be user's selectable according to the person's situation to avoid false alarms.

The disclosed method of sensing provides forms a portable base sensor referred herein as the alarm device. The sensor has a proximity detector capable of being carried by the individual. The sensor may be included in a form to place on a door. A shield is used in the latter case to direct the sensing through the door to detect the presence of someone approaching the other side. It senses the approach of proximity according to the sensitivity selection by the user. It set to approach mode or contact mode. Upon the alarm being triggered the level of response is according to the prescribed methods setup by the user.

The alarm device has an audio alarm module and a light module that can clip onto the device, or a communication module. Thus devices can be added as modules or built into a single unit depending upon the desired marketing and manufacturing technique of suppliers. Thus a means is claimed to add response units such as light flashing, audible alarm, or communication module. The mode of alarm can be set to continuous, or intermitting. Intermitting mode is on each time the sensor detect the presence and then the presence moves away. Continuous mode is after triggering the alarm signal is sent until intentionally disabled.

The communication between devices using the communication module allows for unique device identification, and thus signals are queued according to a programmable response. The alarm device contains memory with a program to initialize the device with the desired mode of operation. The device is easily programmed by buttons on the device, or through a data port on the communication module when present.

In the preferred embodiment, the alarm device contains a motional command sensor MCS as described in the cited patent application. Its signal is then sent to an automatic gain control or AGC amplifier shown in FIG. 2. AGC is essential for mobile operation since local (50-60) Hz signal levels vary significantly in strength with location. A logarithmic feedback signal is used to extend the dynamic range of the system. A FET is used as a variable resistor to vary the gain logarithmically. The AGC signal is then feed into the detector circuit. An automatic background DC offset correction circuit follows the detector. This allows for the use of the high gains required to achieve long range while still observing small varying signals relative to the ambient. A low frequency filtered feedback circuit is used in a differential amplifier to subtract out this background level. The last inverting stage is shown as an option for completeness but was not used in data collection since the data was collected on an oscilloscope with sufficient gain.

Low pass and high pass filters are used to distinguish between the low frequency DC signals and the AC signal. The filters may be digital or analog. Analog filters appearing after the AGC circuit have given impressive results for distinguishing the charge and proximity signals described in the authors previous patent applications title Method and Apparatus for detecting Charge and Proximity. Circuits for the filters are not shown at this time, but they are active filters with cut off frequencies of about 1-10 Hz, and 60-100 Hz. The AC signal indicates approach of a grounded body with decreasing amplitude. The DC component is seen as a result of shifting potentials due to a fixed or slower varying potential on the body due to charge density variation to and polarization of the approaching body. For example the DC offset described due to plastic wands or stylus. The output is measured relative to changes in the background by a differential amplifier that can also provide gain. The DC and AC components are measured by switching the input filters or by having separate receiver channels.

As an individual approaches the sensor, the signal relative to the background decreases as described previously in the MCS patent application. A threshold detector is used to detect a percentage of change in the signal from the reference level determined by the background. Detection and switching logic is provided by a microcontroller. When the signal is detected the alarm and appropriated communication channels are opened. The use of the AGC circuit shown in FIG. 2 allows for a person to hold the MCS sensor and detect movement approaching them or distorted fields.

Figure 5:
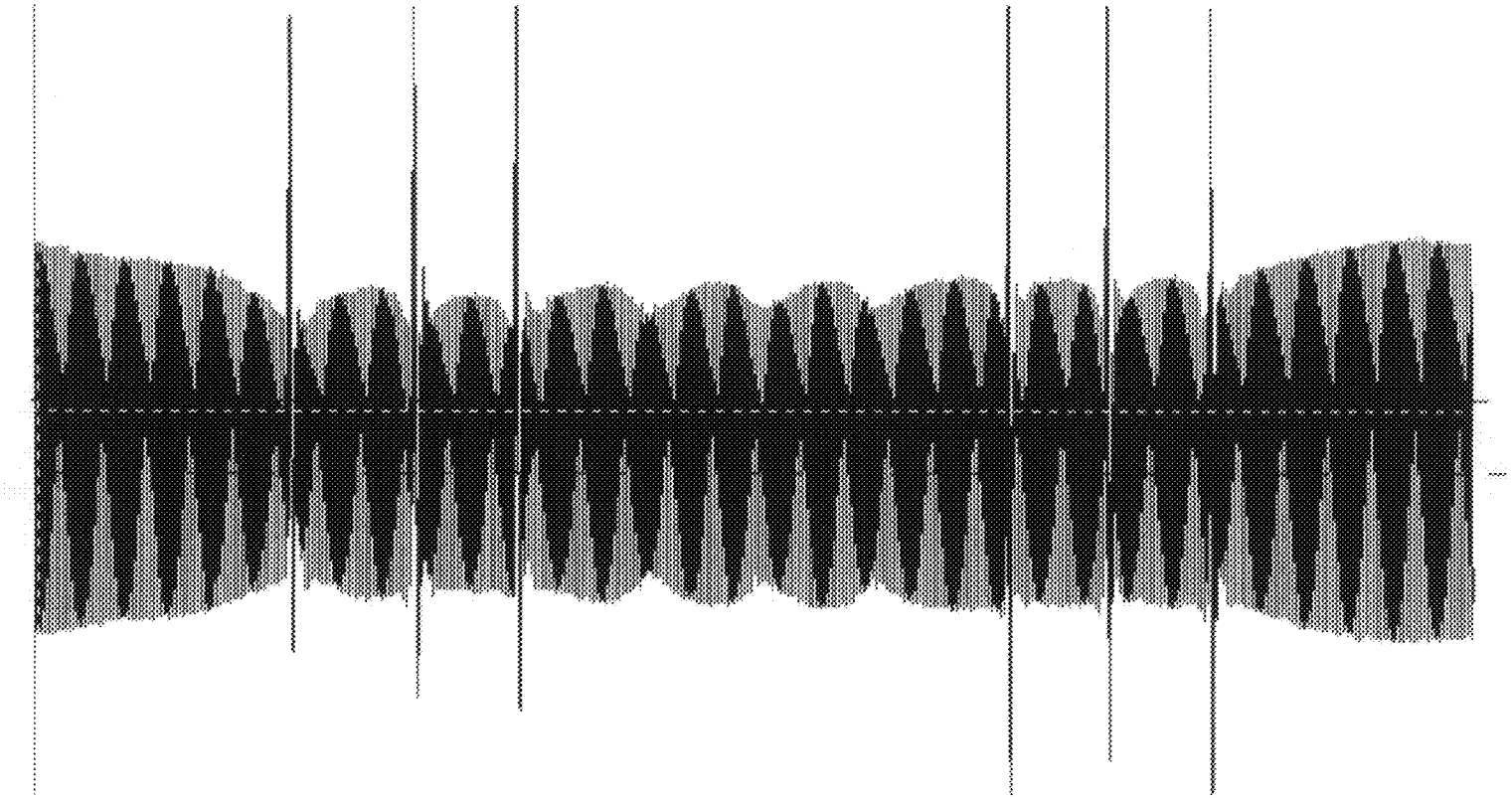
FIG. 5—Drum roll over electrode plate apparatus. A) shows the high pass filtered response, B) shows the low pass filtered response.
Figure 5:
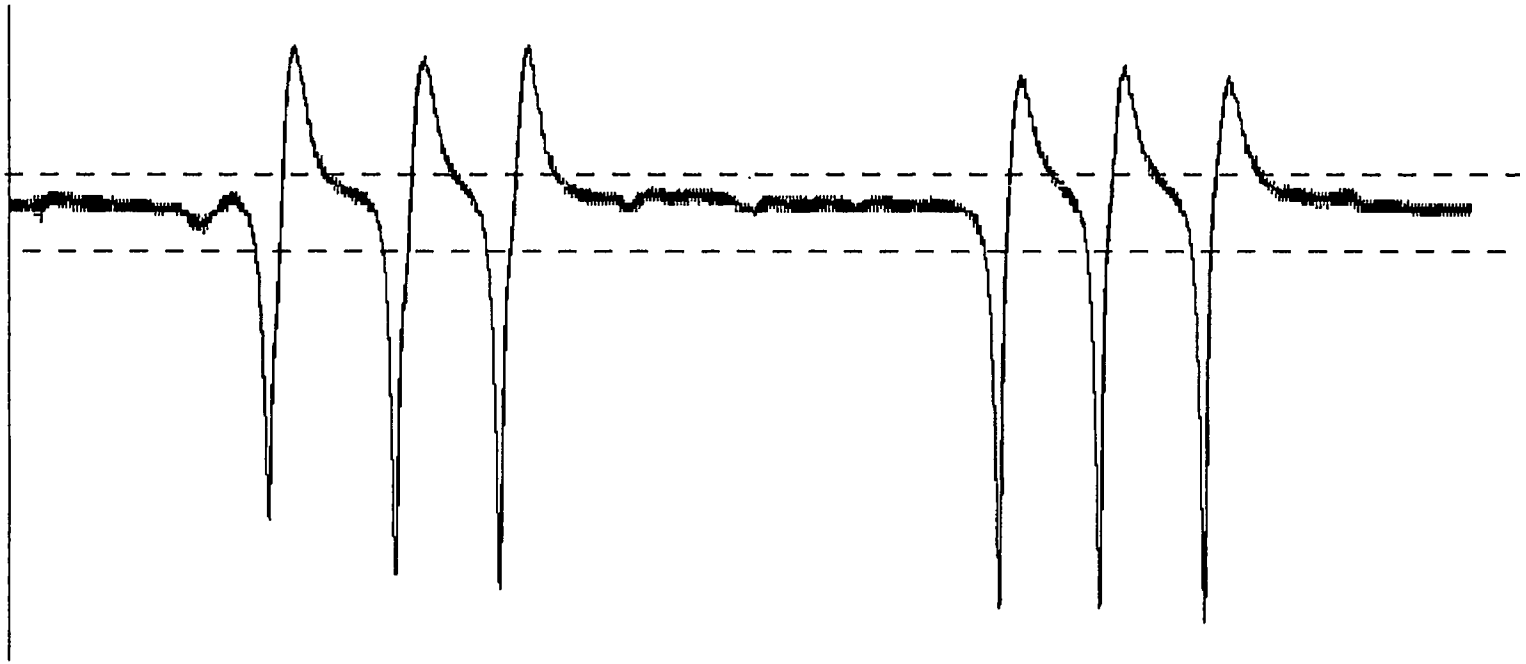
Figure 6:
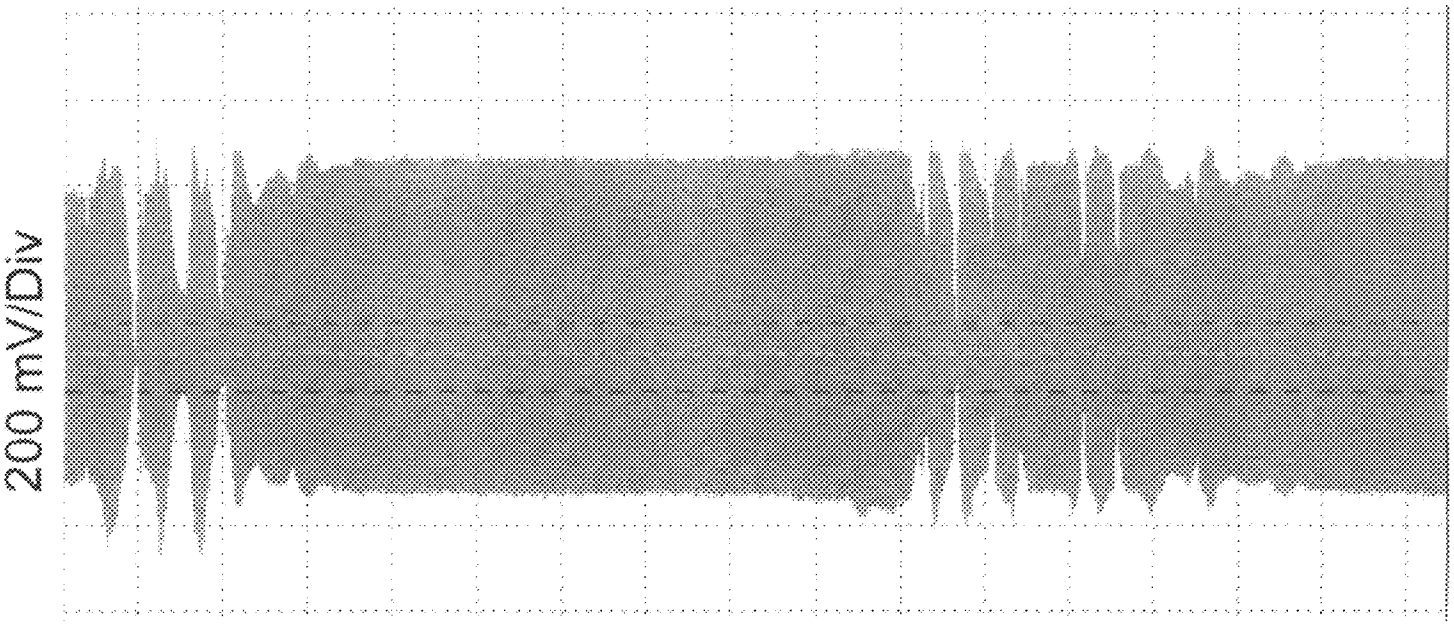
FIG. 6—MCSF response to walking away and then back toward sensor.
Figure 7:
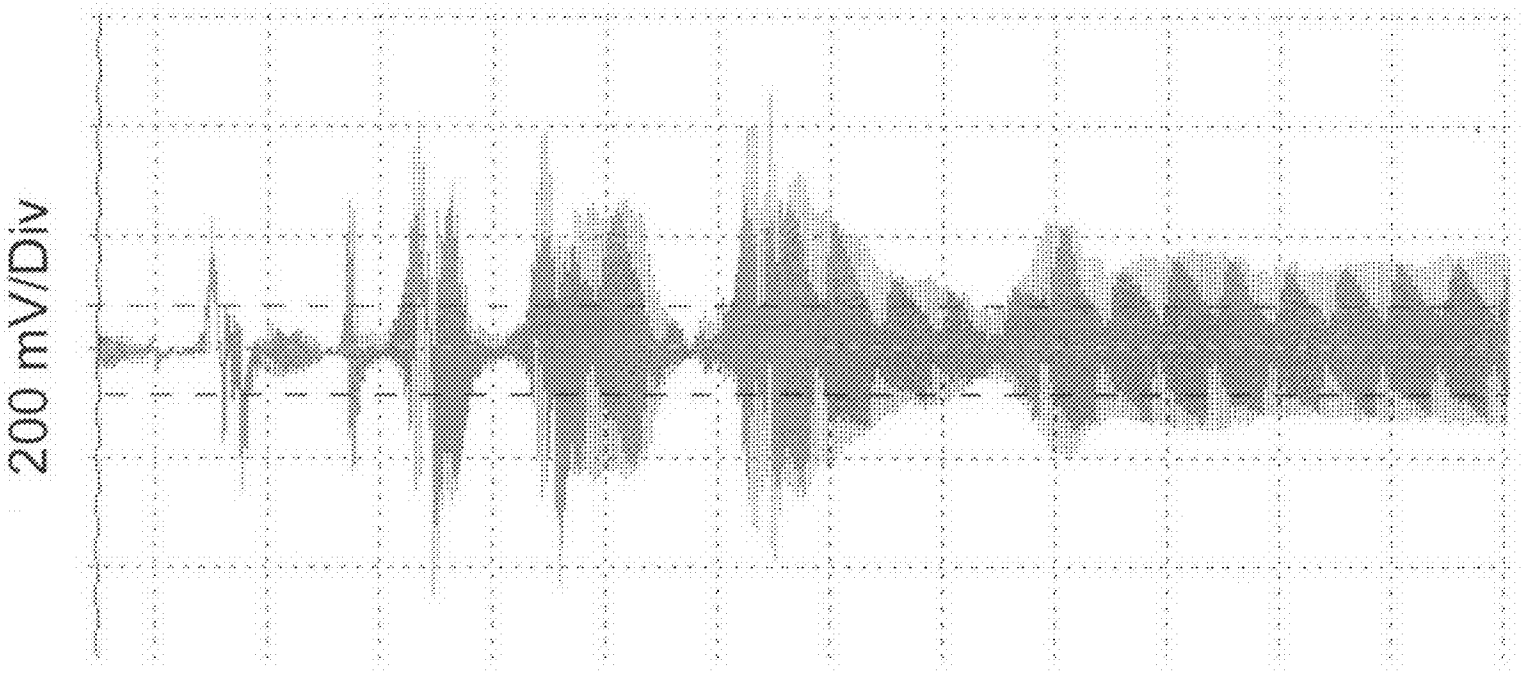
FIG. 7—MCSF Data when holding common electrode and stepping away.

Experiments with the electrode geometry were performed to find suitable packaging and performance enhancements. A plane electrode made from a cookie sheet was placed underneath a wooden plywood sheet with about a ¾ inch separation. A Pyrex plate was support by a metal ham holder about 9 inch above the plate. The MCS sensor was place in the plate. The electrode was grounded and held at 9 Volts above earth ground with a battery. The effect of modulated the voltage was noted as a DC shift in the signal. A notebook was placed over the plate so as to make a flat drumming surface. The AGC circuit along with the filter bank was used to capture drum roll. The person was grounded and held a plastic pen as one drumstick and another covered in aluminum foil. FIG. 5 shows the collected data. The plastic hits and approaches are discernable in the low frequency DC low pass filtered signature. The approaches of the hand with are discernable with the AC high pass filtered signature.

The measurement method and apparatus used in the above sensor and alarms measure the E-field of an object relative to earth ground. It is also desirable to use the same methods but when the measurements are made relative to a floating reference electrode. In the Method for Detecting Charge and Proximity, the charge on the plastic or insulator is recognized when the body holding it is grounded. The grounded body was large and essentially pushes the electric potential to zero in the vicinity of the sensor as the body approach. The body could also be kept at constant potential by a voltage source.

More generally, the potential of a body is not held fixed but floats, and fluctuates with the exchange of charge from the surroundings. Such is the case of a person wearing insulating shoes. Their electric potential fluctuates with movement in an E-field, and from the frictional exchange of charge between the body and its surroundings, or from a charge source such as a battery or ion or electron beam, or just static electricity. The DC potential from a ungrounded body steps on the ground, floor or carpet. Another case is when the body has air blown over it and charges by the tribioelectric effect. The ease of charging or discharging of charge depends on the dielectric constant of the material. The acceptor of a charge is a conductor, and the worst donor is a insulator. The earth ground is an infinite source of both positive and negative charge and ideally over large volumes is neutrally charged.

The motion of the feet of a person causes a charge imbalance on their body that takes place during the frictional exchange of charge from the contact between the floor covering such as a carpet, concrete, dirt or in general the ground and their shoes. The duration of the imbalance depends upon the charging time constant of that body related to the capacitance and isolation resistance. A car for example will develop an DC-like quasistatic DC potential from charge from moving in the air, from the friction of the tires on the ground, and from the external E-field caused by the Earth's electric field and the electrical environment.

It is desirable to sense proximity of bodies since all bodies or objects are not grounded or held at fixed potentials. In fact, we wish to detect proximity, and distinguish between foot steps, and proximity signals of control surfaces from electrically floating bodies.

Figure 3:
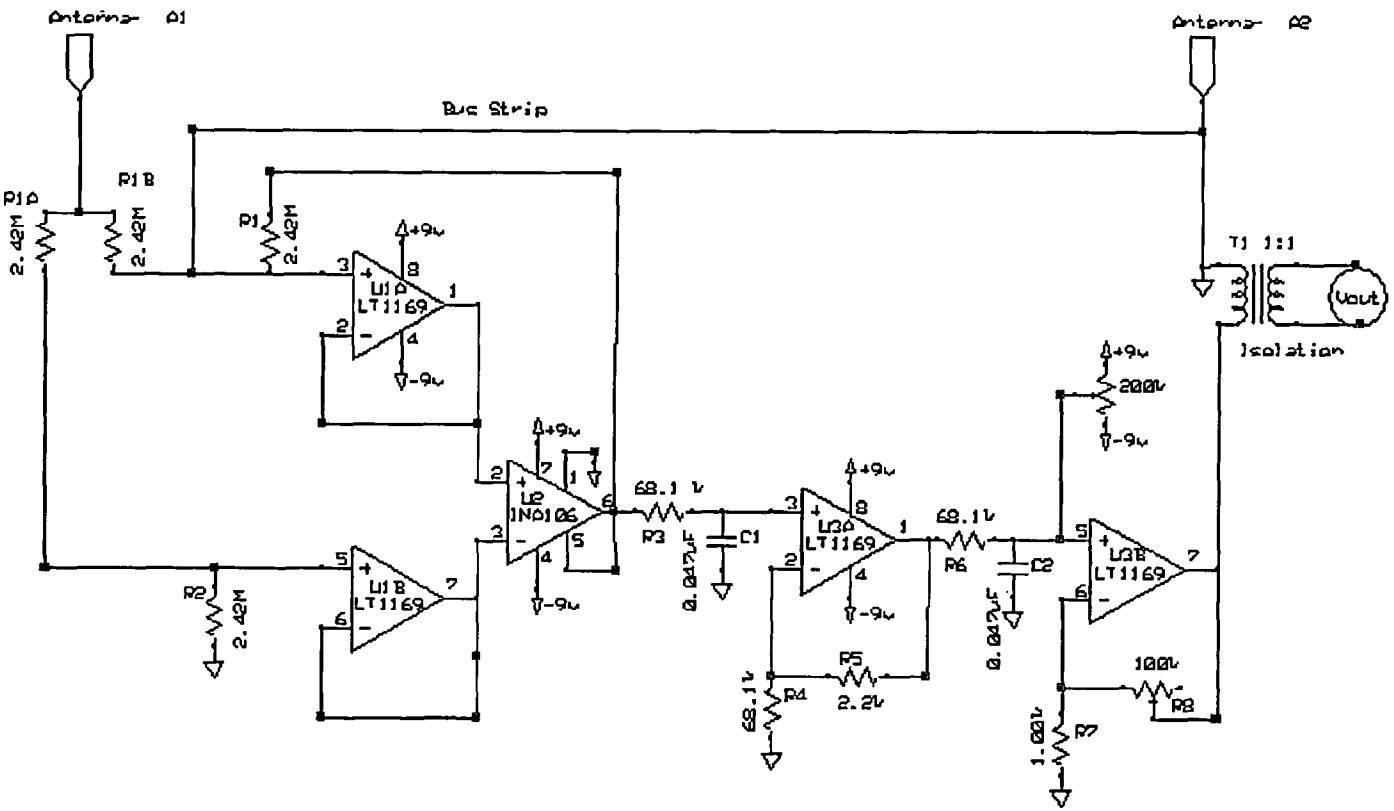
FIG. 3 shows a modified MCS sensor to sense proximity to electrically floating objects called MCSF.

Our disclosed solution is a variant of the MCS sensor so the reference potential electrode is electrically floating. Now there are two sensing electrodes for the sensor, antenna A1, and antenna A2. FIG. 3 shows the schematic. The method uses feedback from the differential amplifier to the reference electrode to keep the signal from saturating while still providing a difference measurement. Large signals are pushed toward zero output with the circuit. This also makes it convenient for detection as saturation is not a problem. Now the potential of the body or control surface need not be fixed because the reference potential adjusts according to potential changes on the body or control surface.

The gain of the secondary stage is adjusted to avoid saturation and a differential amplifier with gain 10 is used. An isolation transformer was used to remove any connecting of the sensor ground to the measurement equipment grounds. Clearly for precise measurements, the effect of instrumentation on the circuit needs eliminated. The output of the transformer was low pass filtered with a single pole analog filter consisting of a 68 kOhm, and 2 microFarads. Modification to the circuit gain is appropriate as necessary to interface to other components of a system. This floating MCS sensor is now referred to as MCSF, for floating variation. It is usable as a replacement for the MCS and the general systems will also function with the MUX, and AGC, and filter circuits described here and elsewhere in the author's patent applications.

The MCSF response to footsteps of ungrounded person is easily distinguishable from a hand pulse. There are two modes of operations, 1) where the reference electrode is not in contact with the body, and 2) when the reference electrode is in contact with the body. The body can then be floating or at a fixed potential. Case 1 is for sensing approach when the sensor is not located on the approaching body. Case 2 is used for when the sensor is in contact with the body, such as holding a palm sized computer or cell phone.

Figure 4:
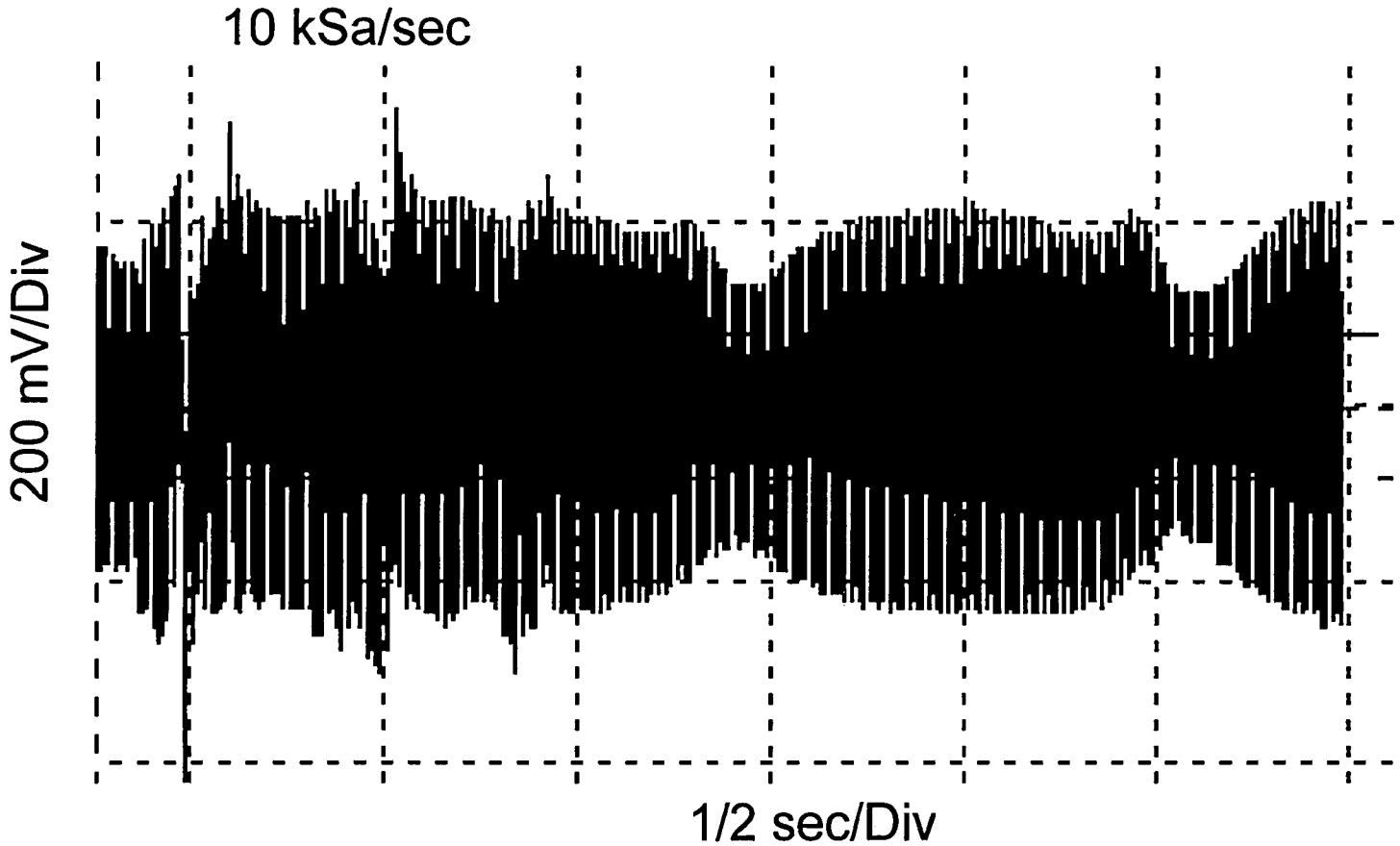
FIG. 4—Data showing MCFS response floating body with first footsteps followed by head bow.

In case 1, the AC signal amplitude is decrease suddenly with a footstep. A footstep has a characteristic signal. The depth of the decrease increases as the person approaches the sensor pair. FIG. 4 shows data for stepping and reveals the distinguishing feature of the fast step signature and slower motional command of a headbow. The signal oscillates about zero volts with very good symmetry. The footsteps only shows up for a cycle or two of the 60 Hz signal and can easily be filtered out from the more slowly decreasing approach of a control surfaces, such as a hand pulse, or head bow, or other motional commands. It is also found that the approach of plastic wand or sword has the similar response as described previously. Thus what is achieved is:

1.1 Footsteps can be counted from an electrically floating body 1.2 Footsteps, and plastic or charge proximity are also distinguished from motional commands.

The range of the experiment was several feet using the described MCSF in FIG. 3 feed into a digital oscilloscope. Greater range is possible with more gain and the AGC and DC offset compensations circuit. The footsteps can be filtered out effectively by analog or digital means to reduce unwanted background noises as well.

Stepping is an integral part of body language, dance, and exercise like walking, jumping, running, and stepping. Steps are also to be considered as a motional command. Steps also indicate physical approach, especially when the signal changes with range.

Monitoring and recording of dancer steps and rhythm is possible for replay the E-field step signature through an audio processor to beat a drum or other indicator mixed in with the music. Thus a replay a training tool is envisioned for dances.

In exercise like walking or running on a treadmill, the speed is known by the speed of the tread; but the length of the gate measured by the time between steps is not. It is useful give people who are training or exercising the ability to know how many steps, and how far between steps. Distance traveled divided by then number of steps tells the distance between foot steps. If a person moves more shorter steps or less long steps provides information about the training level, their calories burned, and training information. On shorter time scales like of minutes instead of the whole workout, intensity levels can be understood and mapped as a record. If one wishes to repeat the same workout, queues, like sound, music tracks, or lights, etc., a signal, can be provided to help in repeating the workout or step sequence such as in dancing. The person who is working out can have motivating music or queues played at preprogrammed training plans, or played from previously recorded step workouts.

The step signals and motional commands described above are detected by the motional command systems (MCS) sensors as stated before can be converted to audio signals or queues audio signals that can be mixed-in the audio stream for a MP3 players or other audio device such as IPOD (™ of Apple Corporation), or cell phone with headsets.

The patent application for a Cell Phone Extension by the author shows how to mix in audio from a regular wired phone to a cell phone or wireless device such as Bluetooth headset. Another claim to from the MCS sensor is the sensor data can be captured on a microphone channel of a common music device either as a digital sound card channel. It is also to be claimed as previously described that the sensor signal or data can be modulated or frequency converted to better manageable audio signals as described in the author's patent application a "A Method for Detecting Charge and Proximity".

As stated in this application, this sensor signal then can be sent over a wireless connection such as Bluetooth that sends audio streams. If an event calls for it, such as an alarm, the phone can be dialed as well. It wireless communication can also us other protocol or RF modulation scheme. Nevertheless, it is claimed in this invention a method of streaming of the sensor signal or data, processed signals on an electronic apparatus or computing device, such as an audio player, portable or not, such as a phone or IPOD audio player, or PC or computing device that provides a Human machine interface like mouse, sound, or video, other multimedia function between the user an the machine. Thus the sensor data such as a step track and motional commands are seen to be able to be mixed into audio data, either directly by gating a drum beat to be mixed in for a sequence of steps, like every one or every other, that corresponds to the movement that is being performed. When the signal is mixed in at audio frequencies, this invention claims the use of Automated Speech Recognition capabilities, or pattern recognition software that can recognize the sensor signals and patterns. Thus a double hand pulse, or two footsteps followed by a head bow, and two hand pulses, for example can be recognized. This is novel because the devices that commonly play the audio like cell phones for example have automatic word recognition built in. Manufactures of devices can easily have find ways to cost effectively include an audio channel for the sensor data in devices such as IPOD etc. Then the use of Hidden Markov Model processors commonly used in speech recognition become usable, for example tool called HTK (Hidden Markov Tool Kit) can now be used to make for a way to build recognizers or patterns where the signal is compared with a training signal. However, to facilitate the uses, we have to modulate the simple slowly varying motional command signals. The author here as frequency shifted a hand pulse signal as shown in the enclosed figures, from the 60 Hz amplitude modulation to 1500 Hz. From that point the signal was frequency modulated according to the amplitude. The frequency band up to 3000 was used. The amplitudes of the signal we first provided a DC offset so the minimum of the digitized AC signal was count was above zero. For example, an 8-bit digitized signal may range from −128 to 127 counts for a 1 volt peak to peak signal. Thus we may add, 129 counts, so the minimum is 1 count. Then it was logarithmically compressed to allow for dynamic range, by digitally taking the log 10 of the ADC counts from the oscilloscope trace to give the compressed signal amplitude function called A(t), where t is time. The ADC counts are normalized by dividing by the maximum count value after the shift of 257. Then the absolute value was taken. Next the FFT fast Fourier transform is taken on time segments of the recorded time trace, and frame duration of 0.1 sec was used. For a an event happening over 3 seconds this give 30 frames to analyze. Larger time frames may be needed to capture the amplitude features and frequency resolution of slower gestures. Fast events may require smaller frame. The frame times are chose to allow the dynamics of the signal of the gesture to be identified time. The log 10 of the amplitude of the log compressed signal is known as the Cepstrum spectrum in speech processing.

Audio resonances of the vocal track are identified by the HTK. Know that we are this far, we see we can create detectable features of the sensor signal by frequency shifting the signal to the audio band to some spectral line amplitudes. A useful approach to making the features is to modulate spectral line resonances at frequencies corresponding to the time difference between the peaks. Since a foot step may be repetitive for a period of ½ second then shifting the 2 Hz spectral line by up-converting by 500 Hz, will give 502 Hz that would be appropriate. This is only one spectral line so, by including harmonics would also be useful to provide more of a feature representation of the 2 Hz foot steps. This amounts to frequency shifting the period of pulses, like from foot steps or hand pulses, or other motional or gesture commands, and including harmonics. This is done by analog electronics as the up-converted described in the author's pervious applications, or digitally by signal processing.

Another, approach is to spread out the signal energy about the center frequency of the 1500 Hz in time according to the compressed amplitude. The signal is then frequency shifted by multiplying the FFT by exp(jwshift), where wshift is the shifted angular frequency that is center on 1500 Hz. Wshift is a function that chirps, or linearly shifts the instantaneous frequency with time of the signal according compressed amplitude. In mathematical form, wshift is $$wshift = 2\pi 1500\left(t \pm \frac{At^2}{3000}\right),$$

so the instantaneous frequency is (1500±A/1500)Hz. The sign was chose by the slope of the signal in time.

The others will see that other modulation schemes are conceivable, such as nonlinear frequency sweeps, and so on, but nevertheless the invented procedure is to up-convert the signals from the sensors to audio stream; because it allows for affordable processing on common hardware and processing architecture like sound cards, and DSP chips, and multichannel processing in electronic apparatus.

Another feature to be claimed in this invention is the gesture sensor can be from either of the MCS sensors that can include that included in the patent application of the author's "AC and DC Coupled E-field Sensor", or the differential sensor described herein MCSF or floating or differential sensor.

In case 2, the signal is suppressed to zero. However, when steps are made the signal level increases. It is also found that when a twisted pair wire lead is used to connect to the resistor pair connected to antenna A1, that the low frequency vibrations of the wires are easily detected. This is perhaps the tribioelectric effect or other but the resonance of the vibration of the cable was observed. This led to the idea of making a jump rope, and an accelerometer, or low frequency microphone. A plastic matt for a chair was used for the experiment. While holding the ground wire, and jumping a response was recorded along with a response of bouncing the wire on the plastic matt. A highly statically charged nylon sleeping bag was also placed near the setup. The apparatus seemed to be sensitive to the static field as the wire vibrated and as the static source moved.

The features of the MCS and MCSF sensors data may also be combined to help discern background noise from actual command or motional command signal. The MCS is good when the body issuing the motional command is at fixed potential. On the other hand background noise from floating potential objects can be subtracted out from an MCS signal by using the temporal signals in the MCFS signal. Any such combination is claimed. An MCS or MCSF sensor with the AGC circuit and filtering, operating in either contact or non-contact mode for the use of controlling or detecting the approach of a body or physical approach is claimed.

Applications of Apparatus and Methods

An application of this sensor technology is to guard swimming pools. An array of the sensors is placed around or within a pool deck or along the sides of the pool to monitor the ambient electric field. They may be placed just above the water line. If a person contacts the water or other electrical grounded items in the area, the electric field distorts and the sensors detect it. Alternatively, the detection of a person moving in the area can also send an alarm, both sensing the AC and DC changes.

Now we describe the operation the sensor system as a wireless leash for children, pets or robots, herein referred to as bodies. A switch on the body modulates its electric potential by switching on and off an antenna connection to a band or collar. The collar or band may include a wire wrapped antenna with an end in contact with the body through an inside electrode. In one case the modulator varies the conductivity between the body and the antenna. Another case is when a modulator opens and closes a switch that shorts together the ends of the wire to amplitude code the signal in time. When the switch is open, the antenna picks up the potential of the background noise and raises the potential of the body. The modulation of the body is detected by the master's sensor system and an alarm is invoked when the signal level drops below a threshold.

This switch technology was disclosed in a provisional application 60/515,844 filed 2003 Oct. 30 to modulate the potential of a bodies contact with the ground. In this new technology disclosed herein, the potential of the body is modulated by a pickup antenna connection to the body. When the body strays beyond a reasonable prescribed distance from the master, an alarm or communication channel is opened between the pet and the master. For example, for a wireless dog leash, such channels are either in the form of live radio communication or recorded play back on the dogs collar.

To detect or identify a child, animal, or object within a range, the background field is modified slightly due to the modulator. The object will switch or modulate the potential of the background as described above. Consider a shoe with a modulator that modulates the body to ground. One was claimed in the MCS patent application. In that application, the usefulness of modulating the potential of a body to facilitate detection was explained to code the E-field to identify the user. The modulation helps identify the multiple users proximate the one another and a MCS sensor. To be more specific, the shoe has a cushion insert. From this the body through the person's sock AC couples to the ground through the dielectric of the sole of the shoe. If we place a switch, perhaps in the cushion or shoe that establishes electrical contact with an acceptable isolation resistance to ground, then the AC signal will be modulated, as well as the DC potential of the person's body. This E-field modulation is detected as allows for identification of the presence. The change in the amplitude of signal carrier gives range change. On top of the modulated signal is still the E-field signal that corresponds to foot steps.

In some cases we may want to estimate range to a walking person by the amplitude of the modulated signal. Using either a code modulation for example quadrature phase shift keying (QPFSK) of the body potential, or the periodic walking of person we compute the amplitude of the modulated signal. The signal to noise ratio gain obtained by using the Fourier Transform is 10 log 10(N), where N is the number of ADC samples captured times the number of records processed. The SNR gain allows the weak signals from the small amplitude modulations to be detected even when the signal is not visible is single measurement, hence a 1 second capture of data sampled a 1 kHz gives, yields 30 dB SNR gain. The speed of the modulation is ultimately limited by the RC constant of the body driven by the switch. The change in the amplitude of the signal with time is indicative of the range to the body. And an increase mean closing on the MCS receiver and a decrease mean moving away.

If the shoe has a transmitter, and a step is monitored with a sensor in the shoe, an detection of such signal can be sent via wireless to a receiver of the guardian each time a step is made. From that reception, and range to the person with the shoe can be monitored by measuring the amplitude of the E-field signal at the corresponding time of the step. If the shoe has a receiver a random switching code or the key to generate one can be passed via a wireless connection to the shoe and modulate the switch accordingly. If it has a transceiver than codes can be exchanged between the master MCS sensor and the shoe. Then the master MCS sensor having knowledge of the code can listen to detect the presence of the person having that code. To use coding increase the signal to noise ratio in a noisy environment. Also other information in time sent by the wireless signal from a shoe sensor about the step such as hardness or acceleration of the body having the shoe, and step gate time can further increase the knowledge of the persons activity and location. Sometimes wireless signals are not well suited for detecting range because of reverberations among other. Since E-field at low frequencies travels through objects and walls, we can us the can use the E-filed signature of the step can provided range information.

In the discussion herein about the shoe switched person, I is noted that in general this invention applies to switching the E-field, both a DC signal or an AC background signal on a body or object, that modifies the E-field proximate MCS type sensors that include the MCS, MCSF, and the MCS2 described in "An AC and DC Coupled E-field Sensor", and further described later in this document.

In some cases it is desirable to having an E-field sensor in a shoe or proximate the person. The E-filed signature from jumping is different depending upon the height of the jump. This is because the force to the floor or quickness of the jump, allows the charge to remain on the body before discharge, and because the higher one jumps the more change in earths E-field that the body is immersed in. Also there is a difference between people because of the shoe and the way the foot hits the ground. The author found that using graphite orthodic shoe inserts gave a different time dependent signature than other shoes. This behavior is understood by the different conductivity, and dielectric constants, and from the mechanical flexing of the orthodic that changed the conductivity. Hence such a method could also be used as a modulator, a mechanical contact that flexes when on walks to aid in detection features.

The MCS sensor described in Ser. No. 10/772,908 makes for a good jump sensor or hand pulse sensor when interested in short range. It responds to the nonzero potential of the body. Grounding the body gives no noticeable response. Also placing the MCS E-field sensor on the grounded floor gives no measurable response at the working resolution because the floor becomes a zero potential E-field relative to earth ground.

Figure 8:
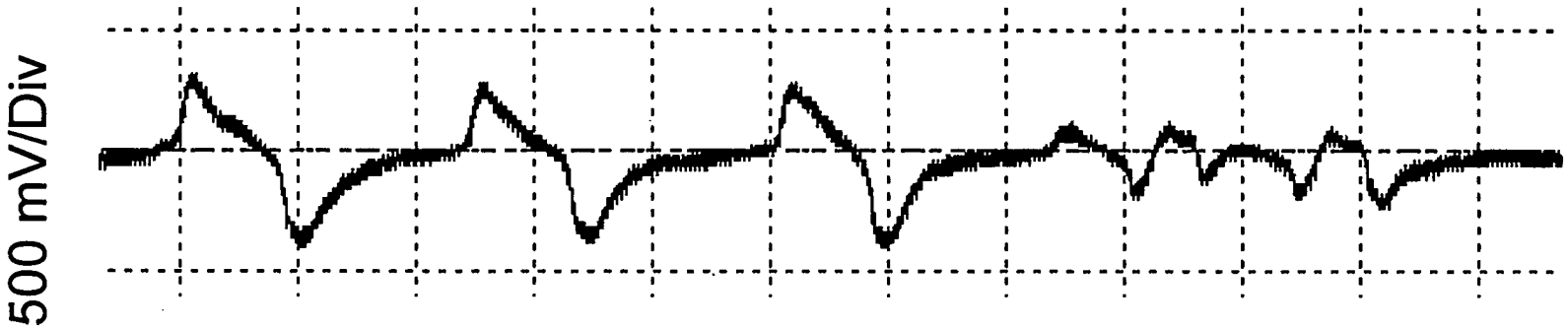
FIG. 8—MCS Jump data showing 3 Jumps on carpet with graphite shoe inserts using Jump Sensor and 4 foot marches.

The MCS sensor AC sensitivity is reduced by filtering most of the 60 Hz AC out at the antenna input with shunt capacitor of Cant. The DC and AC sensitivity is reduced by reducing shunt resistance R1. FIG. 8 show a trace using Cshunt=0.047 uF and using R1 of 1 MOhm. There is minimal 60 Hz to be seen, and it is a DC detector at this resolution. Also a capacitor of 10-100 pF was used to series couple the antenna of the E-field sensor to the input. This was just as a precaution avoid DC bias amplifier input from static charge. This also forms a high pass filter and reduces the capacitance of the antenna. The combination of the filter response are tunable to shape the impulse of the jump or hand pulse. Where R1Cant is time constant for the low pass filter, and Cseries taken in parallel with antenna series capacitance multiplied by R1. The antenna series capacitance is estimated as 1-2 nF by looking at voltage drop measurements for a 4 in long antenna. If we are detecting short range, the DC response of a jump was seen well. The new useful effect is the DC signal only that responds to nongrounded bodies.

The MCS2 sensor has no external shunt resistor R1, an was found that its DC and AC sensitivity of a single unity gain input buffer is about 500-1000 times that of the MCS sensors input buffer stage having a shunt resistance of R1=2.4 MOhm. DC voltages swing about rail to rail 16 Volts. This amplifier allows for detection of grounded bodies and nongrounded bodies, and allows for sensitive detection of coded body signals.

Some similar behavior of this amplifier was initially indicated with the MCSF circuit described herein. One feature that is convenient is the AC signal is made to decrease with the approach of an ungrounded body having a DC unreferenced field. The differential output of the AC signal was adjusted depending upon the DC signal level of the reference electrode.

The MCS2 amplifiers operates without an R1 shunt bias resistor tend to have offsets and often saturate. If the gain were increased from a unity gain noninverting op amp configuration, it would surely saturate. This was seen as a problem, but the author has shown that we can overcome the problems and get a supersensitive E-field sensor that exceeds the DC sensitivity of Zank et al. Additionally the AC sensitivity adjustable by DC level input to the amplifier.

The MCS2 sensor is an extremely sensitive sensor to DC and AC. By having created potential on an neighboring electrode to the antenna electrode or by electrically driving the antenna, we are able to adjust the DC output level of the MCS2 sensor. This is the same as described herein with the MCS circuit as a DC offset occurred when the conducting plate underneath the sensor was held at 9V with a battery. A new feature is the antenna is driven by a voltage source such as a battery or the output of another MCS2-Reference sensor that senses the neighboring field. We like to operate the MCS2 with the DC output of an to have about −6V DC for a +/−9 dual voltage supply.

Another feature is the AC signal can be the 60 Hz background from sense sensor can be inverted with an inverting opamp circuit and added to the MCS2 input electrode or neighboring electrode to allow control of the AC amplitude at the input. The net AC amplitude at the input of the MCS2 should be held close to 2-3 Volts. Thus the DC coupled output will have a minimum of −7V to −7.5V. We want to be sure the AC amplitude does not clip at the supply rails. When the driven AC signal is provided by an external reference, it is possible that it does not get it from the AC background, but from an oscillator or clock, or some means of a synthesiser. The input should be isolated well from ground or be high impedance source so not to load the input, and allow for E-field generation from the antenna so a grounded body can intercept the E-field and decrease the voltage input to the sensor. The decrease in the corresponding AC output will still operate as stated. Thus a grounded body or a body of nonzero potential, relative to earth ground, can make the AC output of an MCS2 decrease. In the grounded case the input voltage is reduced to the MCS2 amplifier like in the MCS AC circuit. In the nonzero potential case, the shift of the DC offset adjusts the gain. Also the effect of polarization of a grounded body holding plastics, or having statically charge material like polyester cotton shirt or other material that generates charge from air or holds a charge or other polarized object is also seen with the MCS2 amplifier. Thus we can hold a charged object that If the body is not grounded and the body holds a charged object the sensor works fine showing a DC sensitive shift and an AC output decrease.

The behavior of using negative DC bias was found convenient, and similar behavior happens the DC bias is reduced below approximately 6 Volts. The +/−6 volts bias level for nonlinear AC gain seems particular for the TL082 device and can change between devices, and must be determined. Anyone experience in electronics can determine other operating conditions, but this MCS2 sensor invention has the ability to decrease an AC signal whether background or synthesized due to DC shifting and AC loading of the amplifier input. If the charge of the body is opposite of what was demonstrated the DC shift will first be in the opposite direction. However, we not that there tends to be a positive swing followed by a negative swing for our demonstrated case with the body on shoes on polyester carpet, or wearing a polyester shirt. Since there is a positive and negative swing, due to time of charge polarizations or rearrangement, the same bias point will work at for both positive and negative charges, the sensor will just trigger a decreasing AC on the part of the DC signal that causes the nonlinear behavior. A DC signal shift can swing from the negative to positive nonlinear bias threshold too. Those skilled in the art of electronics and static fields can work out bias combinations for detecting positively or negatively charged bodies.

Figure 11:
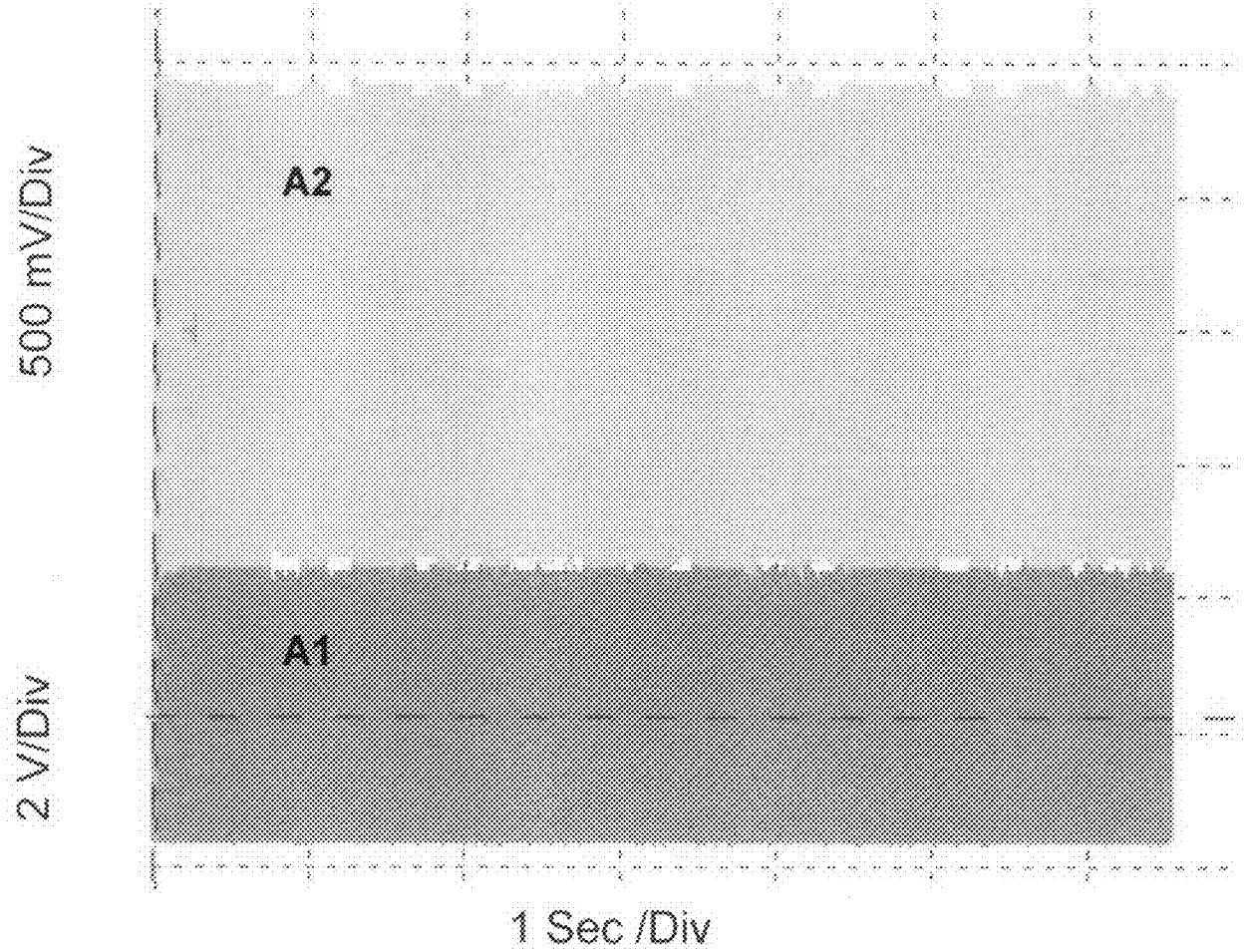
FIG. 11—MCS2 Modulated body with contact with −9V battery switch open is low.
Figure 12:
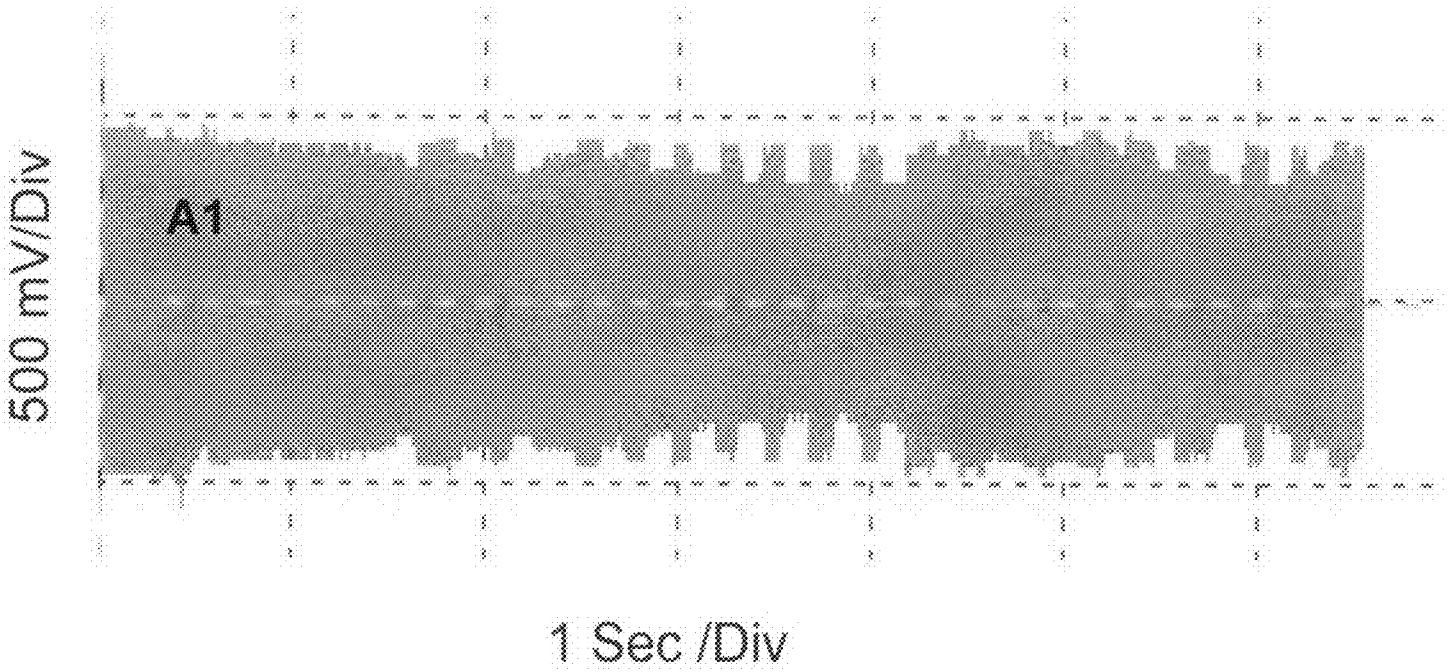
FIG. 12—MCS signal of grounded body modulated by opening connection to ground.

Opamps tend to become nonlinear when the DC offset is near the potential rail. So what happens is when an ungrounded body passes the potential DC shifts positive and then negative goes negative. When this happens the AC gain increases with the positive DC offset, and decreases with a negative DC offset. When the DC input get to the negative rail, the amplifier output becomes zero. High pass filtering of the input by using a capacitor like 2 nF does not seem to do much to the shape of the response as the DC response is low because of the high internal impedance of the opamp. When a body is grounded and left hand approaches the sensor when the finger of the right hand comes in simple contact with battery of +9 V and −9V through 1.4 MOhm resistor, the AC output decreases, but for different reasons. One is because of the MCS behavior of reducing the AC input to MCS2 by shunting of the body to ground. The other is because the DC was shifted. The DC shifted positive or negative according to the potential applied to the body. The resistor was large to limit current for safety. The modulation is seen for the MCS2 when the hand was stationary in front of sensor for FIG. 10, FIG. 11. FIG. 12 show ground modulation for the MCS sensor when the body was approaching the sensor, and thus the envelope decreased.

Figure 10:
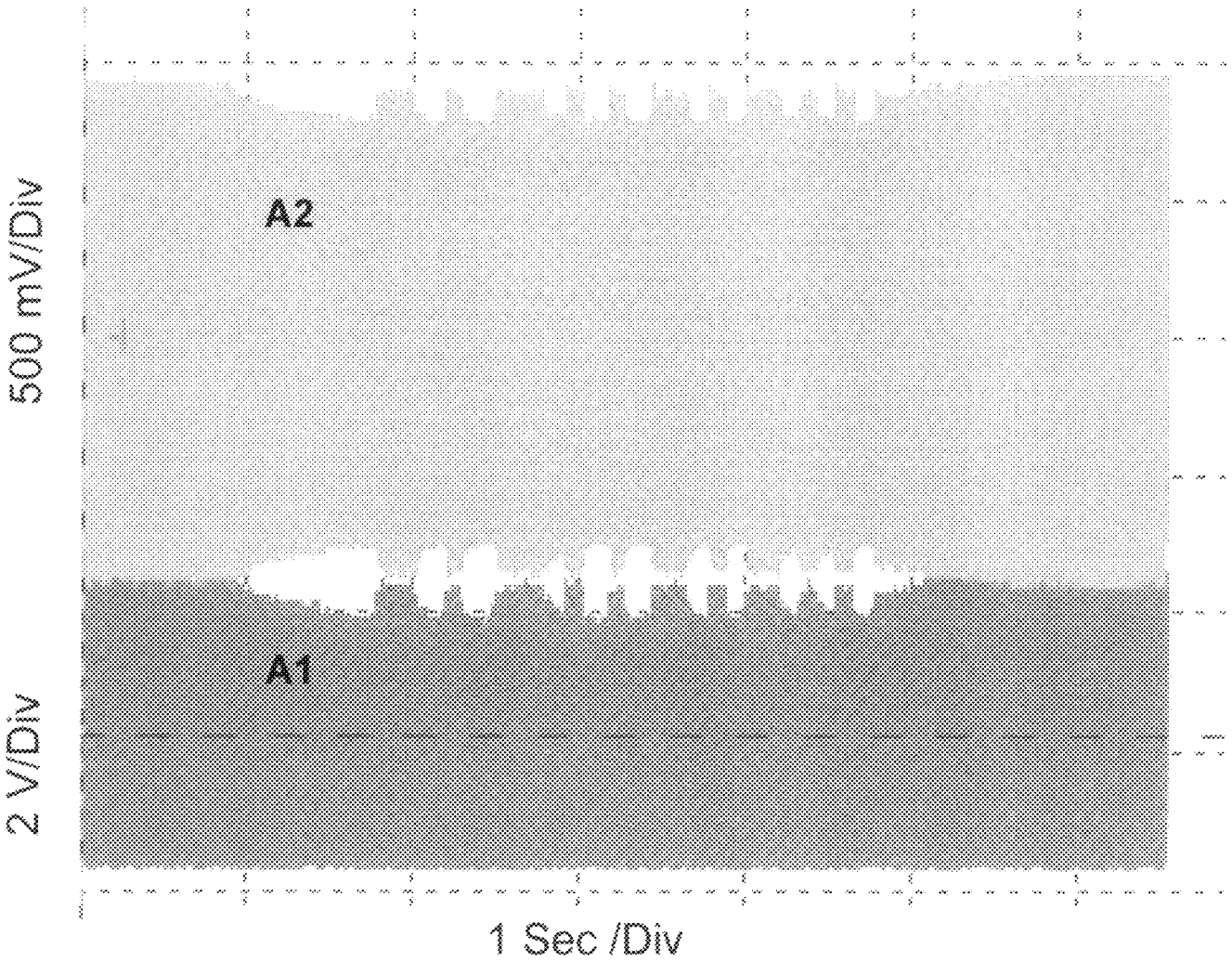
FIG. 10—MCS2 Modulated body with contact with +9V battery switch open is high.

The is such great sensitivity to modulation of the AC and DC waveform at the output of the MCS2. It is sensitive to just touching the 9 V supply. The AC or DC can be filtered differently. FIG. 10 shows this.

Figure 9:
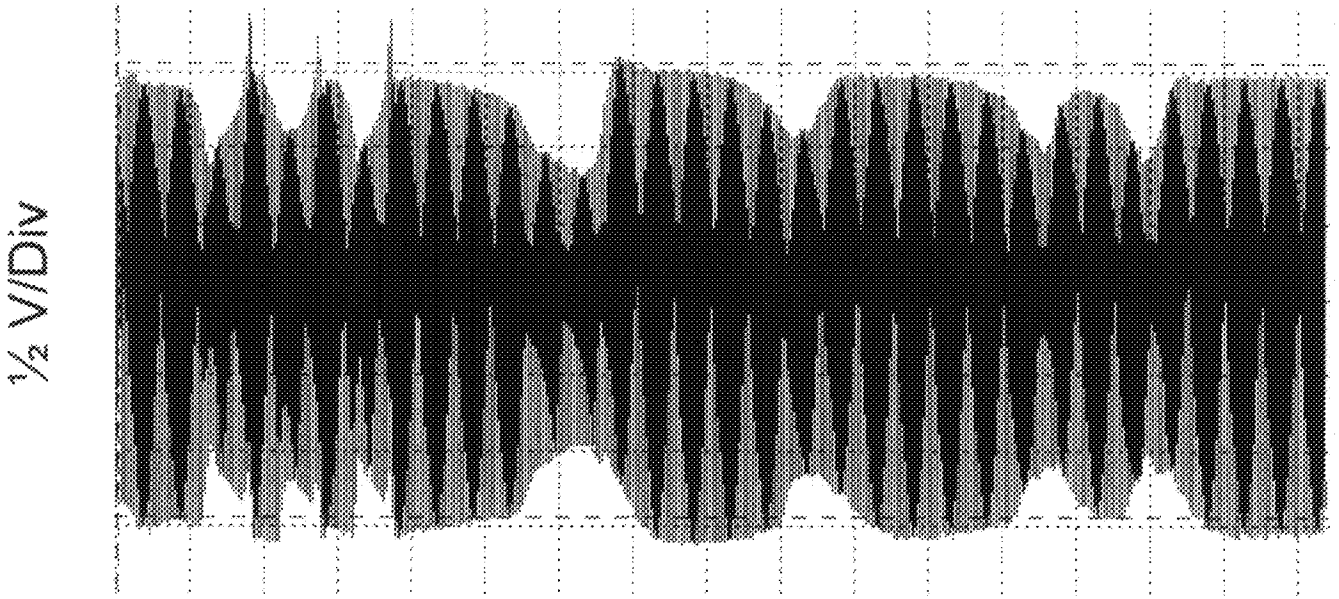
FIG. 9—A) AC output of MCS2 3-Foot Steps followed by 4 Hand pulses when body is ungrounded; B) DC coupled oscilloscope trace of input signal to the antenna of MCS2 from the MCS2-REF.
Figure 9:
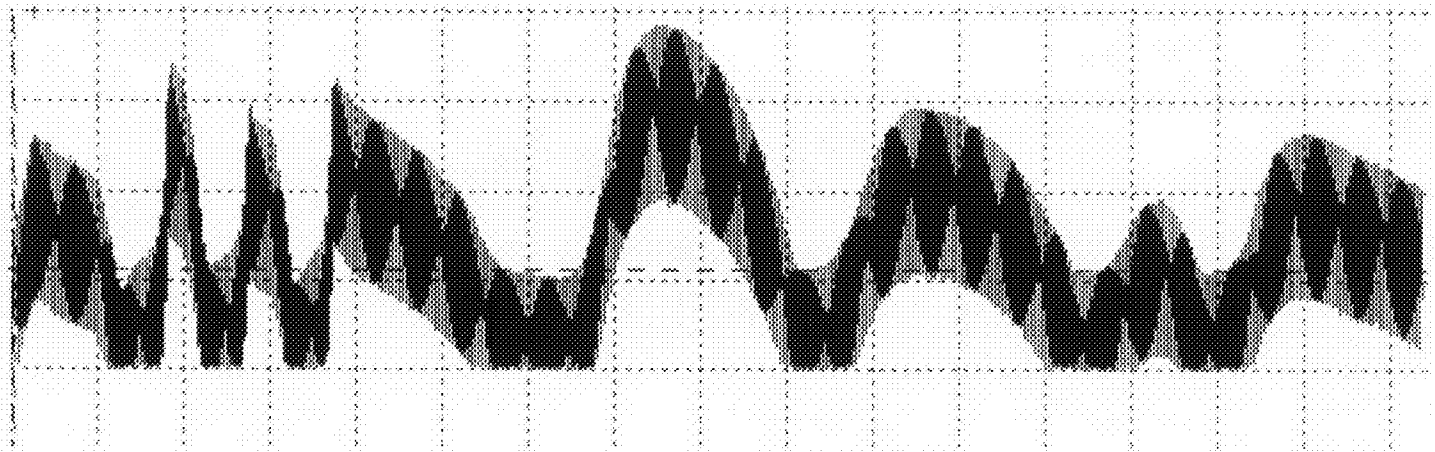

Then the AC output is filtered with a high pass followed by a low pass filter. The high pass is made with 0.044 uF capacitor and a 68 kOhm resistor. The high pass filter is made from a 0.044 uF capacitor and a 39 kOhm resistor. These values are operating and can be changed for production for ease of part reduction, commonality, and placement, but result in a good looking signal. The output AC signal is about 1.4 V rms. FIG. 9 shows a trace of the AC signal and the antenna electrode drive signal obtained from a MCS2-Ref separated 2 inches from the MCS2 antenna. The antennas are 9 inches long ½ inch wide copper tape of about 0.1 mm in thickness taped flat and parallel on a ¼ inch two-ply glass substrate with plastic safety glass laminated between. A center electrode between them was 18 inch long tape. On the center electrode a 5 in long by 3 inch high double sided copper circuit board, bare copper no etchings or circuits, centered vertically on its 5 inch edge. The board is electrically connected to the center electrode on one side. The center electrode was not connected but may increase background signal.

Figure 2:
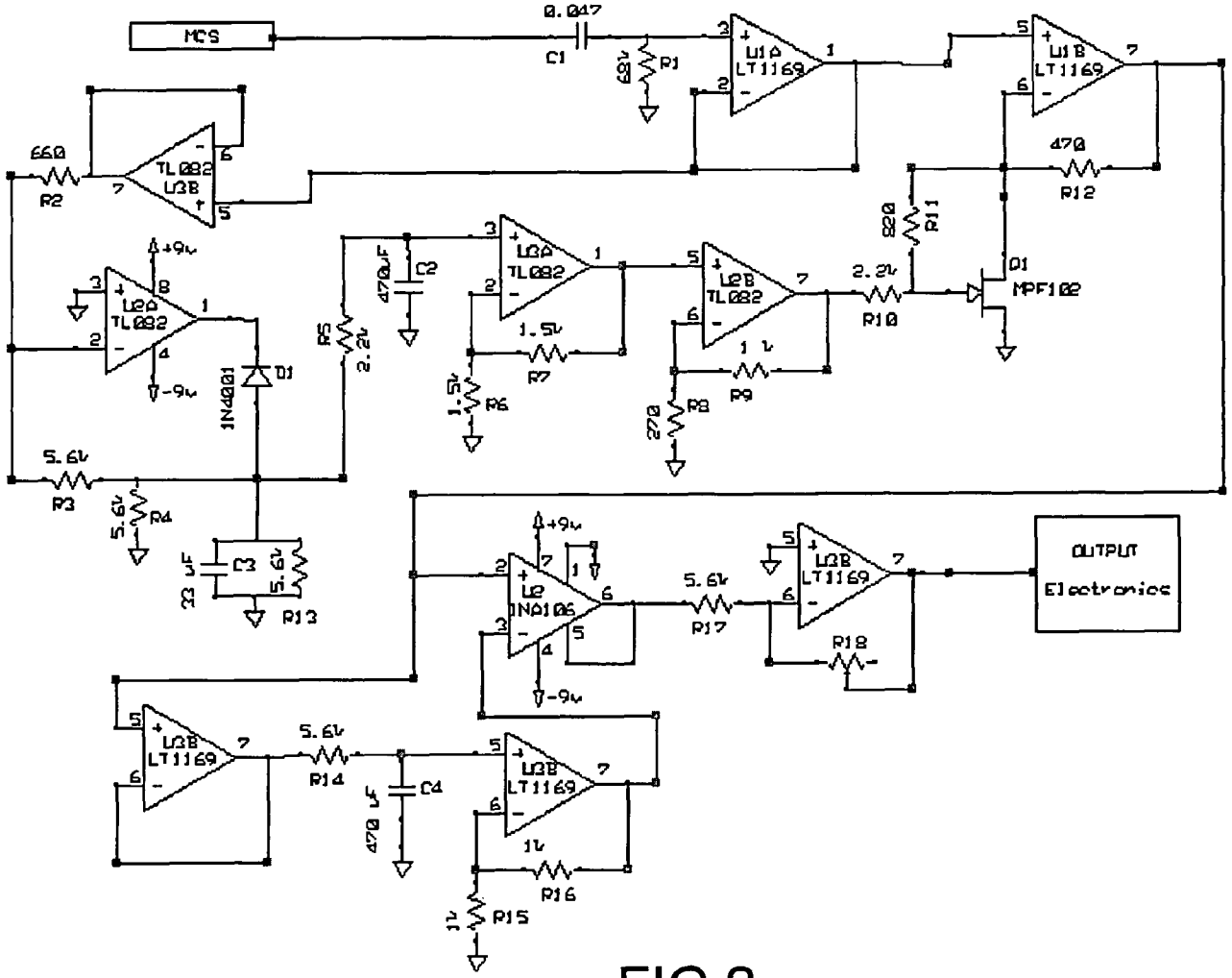
FIG. 2 shows AGC circuit with ambient DC offset correction.

The MCSF, and MCS used with AGC and DC offset shown in FIG. 1, FIG. 2, and FIG. 3, show that we are subtracting off the unwanted signals using the difference amplifiers. The unwanted signal can be the DC or the AC signal, by filtering the feedback loop. There were multiple stages and they are DC coupled.

The MCS2 actually can replace the MCS in FIG. 1 and then follow with the additional circuitry. The subsequent use of the DC coupling between stages may be relaxed in some cases as the AC coupling may suffice for some applications, depending what is most cost effective.

It is also possible to make instruments, or toys, and games and video games that trigger a response according to physical approach. This is such as one playing the drums. As a drum player hits a stick on a drum or sensor pad, or perhaps as a boxer punches a training bag, the system counts or responds accordingly. Thus the invention claims use in exercise and recreational equipment.

This invention also is useful a door sensor that mounts on the inside of the door and indicates when someone is entering. Till now most everyone has experience the awkwardness of a collision that occurs when entering through an opaque door. When this invention is used as a sensor on the door the problem is avoided. A metal shield is placed on the back facing the person leaving the room. The shield makes the sensors more sensitive in the forward direction. Another unique feature of the sensor is sensitive through the door. It then detects the presence of a person approaching from the other side. Notification is given to the person leaving the room when a person approaches on the other side. This is done with a light or other indicator like sounding a beep or buzzer. A light is convenient because it makes no disturbing noise. Either type of alarm can be mounted right on the sensor system. The sensor must also know to only alert those leaving the door when someone is about to have a collision with them. The signal strength from the front to back of the sensor, where front senses entering, and back senses leaving, has to be set at the appropriate threshold so those entering are detected prior to the person who is leaving gets within the range of the door where a collision would normally occur. The E-field sensor system is useful because there is no need to have separate sensors and alarms on opposite sides of the door or wall. There is also no necessary destruction to the door, and no need to have unsightly auxiliary units such as radar or sonar sensors outside the door. Thus what is specifically claimed is a sensor system for avoiding collisions that does not physically appear on the sensing side of the door, wall, or barrier like a car. This disclosed method of sensing helps with appearance and also eases installation, and avoids damage due to tampering.

This is an innovative solution to collision avoidance. The solution to this problem with this invention was referenced in the stated applications. The described apparatus is believed to be an invention in itself and is claimed.

Additionally, since such a device is new, a general claim of an entrance way collision avoidance device using people sensing technology and a communication link to notify those of leaving the doorway of those appearing. The communication link can either be wireless or non-wireless technology. The sensors can be infrared or sonic mounted outside, or in a peep hole in the door.

In general though the collision avoidance system is really a method and apparatus for detecting physical approach. An alarm in an automobile or is one where the sensor is fixed and there is no one else near it other than an intruder. A smart alarm such as described here will be able to determine the difference between those permitted and those not. This application offers methods using E-field sensors. Other sensors types are possible, and combinations thereof, but never less the ideas conveyed here are the same.

A method and apparatus is presented useful for keying and interacting with portable electronics by touchless movement of the fingers, hands, and feet or other body motional commands. This invention also applies to various types of alarms of physical approach.

What is claimed is:

1. A device for detecting presence or motion of interest in an area, comprising:

an E-field sensing antenna for sensing AC components of an E-field within the area;

a high input impedance amplifier having an input coupled to the E-field sensing antenna and producing output signals related to the sensed AC components of the E-field sensed;

an AC signal source adapted to generate an AC signal in the area, and wherein the AC components being sensed includes the E-field of the AC signal from the AC signal source; and a means for detecting sensed AC signals of interest and providing an response signal response indicative thereof, said response signal indicating presence or motion of interest in the area.

2. A device for detecting presence or motion of interest in an area according to claim 1, wherein the AC signal source has a high impedance output, wherein presence or movement of interest in the area varies the AC signal from the AC signal source sensed by the E-field sensing antenna.

3. A device for detecting presence or motion of interest in an area according to claim 2, wherein the AC signal source having high impedance output is electrically coupled to the E-field sensing antenna while maintaining sensitivity of the high input impedance amplifier to the E-field in the area, and wherein presence or movement of interest in the area varies the AC signal from the AC signal source sensed by the E-field sensing antenna.

4. A device for detecting presence or motion of interest in an area according to claim 3, additionally including, a second E-field sensing antenna for sensing AC components of the E-field within the area from the AC signal source;

a second high input impedance amplifier having an input coupled to the second E-field sensing antenna and producing output signals related to the sensed AC components of the E-field sensed;

a difference circuit for creating an AC difference signal output representative of the difference between the outputs of the AC signal sensed by the high input impedance amplifier and the AC signal sensed by the second high input impedance amplifier;

wherein presence or movement of interest in the area varies the AC difference signal, wherein particular sensed variations in the AC difference signal from the AC signal source are used to provide a response signal indicating presence or motion of interest in the area.

5. A device for detecting presence or motion of interest in an area according to claim 4, wherein the area includes the E-field generated by the AC signal source, and the E-field sensing antenna and the second E-field sensing antenna are separated in space.

6. A device for detecting presence or motion of interest in an area according to claim 5, wherein a portion of the AC difference signal is used to control strength of the E-field in the area produced by the AC signal source.

7. A device for detecting presence or motion of interest in an area according to claim 4, wherein the second E-field sensing antenna is electrically coupled to a user's body so the AC signal sensed by the second sensing antenna is conducted by the user's body with presence or motion within the area, wherein particular sensed variations in the AC signal from the AC signal source provide control signals for controlling the device to be controlled.

8. A device for detecting presence or motion of interest in an area according to claim 7, wherein the device to be controlled is a computer, and the user's body is coupled the second E-field sensing antenna by making physical contact with the device, such as while holding the device.

9. A device for detecting presence or motion of interest in an area according to claim 4, wherein the E-field sensing antenna is electrically coupled to a user's body so the AC signal sensed by the second sensing antenna is conducted by the user's body with presence or motion within the area, wherein particular sensed variations in the AC signal from the AC signal source provide control signals for controlling the device to be controlled.

10. A device for detecting presence or motion of interest in an area according to claim 9, wherein the device to be controlled is a computer, and the user's body is electrically coupled to the E-field sensing antenna by making physical contact with the device, such as while holding the device.

11. A device for controlling the interaction with a computer by detecting presence or motion of interest of a user's body in an area according to claim 3, wherein the AC signal source has a high impedance output, and presence or movement of interest in the area causes a decrease in the AC signal amplitude as sensed by the E-fleld sensing antenna from the AC signal source with decreasing separation between the user's body and E-field sensing antenna, wherein particular sensed variations in the AC signal from the AC signal source provide control signals for controlling the device to be controlled.

12. A device for controlling a computer by detecting presence or motion of interest user's body in an area according to claim 2, wherein the AC signal source has a source antenna and the E-field sensing antenna is separated in space from the AC source.

13. A device as in claim 1, wherein the E-field sensing antenna is coupled with a high pass filter to the high input impedance amplifier input.

14. A device for controlling a computer by detecting presence or motion of interest user's body in an area according to claim 13, wherein the AC signal source has a source antenna and the E-field sensing antenna is separated in space from the AC source.

15. A device for controlling a computer by detecting presence or motion of interest user's body in an area according to claim 14, wherein the device the E-field sensing antenna is electrically coupled with the user's body by holding the devices, wherein the user's body moves closer to the AC signal source the AC signal from the AC signal source is conducted through the body to the E-field sensing antenna resulting in variations in the AC signal at the E-field sensing antenna, wherein particular sensed variations in the AC signal from the AC signal source provide control signals for controlling the device to be controlled.

16. A device for controlling a computer by detecting presence or motion of interest of a user's body in an area according to claim 4, wherein the difference circuit is a difference amplifier.

17. A device as in claim 4, wherein the second E-field sensing antenna is coupled with a high pass filter to the high input impedance amplifier input.

18. A device as in claim 17, wherein the wherein the difference circuit is a difference amplifier.

19. A device for controlling a computer by detecting presence or motion of interest of a user's body in an area according as in claim 14, wherein the device to be controlled is a computer, and the user's body is electrically coupled to the E-field sensing antenna by making physical contact with the computer, such as while holding the device, wherein presence or movement of interest in the area of the user's body causes sensed AC signal variations with presence or movement of interest in vicinity of the AC signal source; wherein said AC signal variations are processed to provide a response to the user's motion wherein the device controls the computer.

20. A device for detecting presence or motion of interest of a user's body in an area according to claim 3, wherein the AC signal source has a high impedance output, and presence or movement of interest decreases the AC signal amplitude sensed by the E-field sensing antenna from the AC signal source with decreasing separation between the user's body and E-field sensing.

* * * * *